US008655215B2

(12) United States Patent
Testardi et al.

(10) Patent No.: US 8,655,215 B2
(45) Date of Patent: Feb. 18, 2014

(54) METHOD FOR REDUCING WEAR ON AN ELECTRO-PHOTOGRAPHIC PRINTER DRUM

(75) Inventors: Steve Testardi, Boise, ID (US); Anthony Holden, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/547,998

(22) Filed: Jul. 12, 2012

(65) Prior Publication Data

US 2013/0183054 A1 Jul. 18, 2013

Related U.S. Application Data

(62) Division of application No. 12/239,939, filed on Sep. 29, 2008, now Pat. No. 8,247,152.

(60) Provisional application No. 60/986,109, filed on Nov. 7, 2007.

(51) Int. Cl.
*G03G 21/00* (2006.01)
*G03G 15/00* (2006.01)

(52) U.S. Cl.
USPC ..... 399/71; 399/343

(58) Field of Classification Search
USPC ..... 399/71, 343, 346, 350
See application file for complete search history.

(56) References Cited

U.S. PATENT DOCUMENTS 5,107,285 A * 4/1992 Hamada et al. ..... 347/130

FOREIGN PATENT DOCUMENTS

JP 09120238 A * 5/1997

* cited by examiner

*Primary Examiner* — David Gray
*Assistant Examiner* — Erika J Villaluna
(74) *Attorney, Agent, or Firm* — Erik Anderson

(57) ABSTRACT

A method for reducing wear upon an electro-photographic printer drum includes the steps of determining a non-image region of a page to be printed, applying a halftone pattern of toner to a portion of the printer drum corresponding to the non-image region, and rotating the printer drum against a cleaning blade, the halftone pattern of toner providing lubrication between the drum and the cleaning blade.

13 Claims, 4 Drawing Sheets

METHOD FOR REDUCING WEAR ON AN ELECTRO-PHOTOGRAPHIC PRINTER DRUM

CROSS-REFERENCE TO RELATED APPLICATION

This Utility Patent Application is a divisional of, and claims priority to, prior Utility patent application Ser. No. 12/239,939, filed on Sep. 29, 2008 now U.S. Pat. No. 8,247,152, which is based on and claims the benefit of U.S. Provisional Application No. 60/986,109, filed on Nov. 7, 2007 the contents of which are hereby incorporated by reference in their entirety.

BACKGROUND

The present disclosure relates to electro-photographic printing devices, such as laser printers and the like. The electro-photographic (EP) drum in a typical electro-photographic printer is typically designed to last a certain number of rotations, based upon the page yield of the toner cartridge, plus a certain amount of margin. In certain usage conditions, however, such as when printing on narrow media, the drum can wear out when there is still a significant amount of toner remaining in the cartridge.

One of the major contributors to wear of the printer drum is friction between the surface of the drum and a cleaning blade, which is positioned against the drum and removes un-transferred toner from it prior to development. Residual toner on the drum normally serves as a lubricant and reduces friction with the cleaning blade during normal use. However, in cases where a user prints on narrow media (such as envelopes), or prints a pattern with uneven distribution of toner across the page width (e.g. columns of numbers) there can be substantial areas in which no toner is applied to the drum, resulting in increased friction for those areas. This can lead to uneven wear of the drum and ultimately to failure of the charge transport layer of the drum. This can result in print quality defects, and, ultimately, the leaking of toner into the printer.

BRIEF DESCRIPTION OF THE DRAWINGS

Various features and advantages of the present disclosure will be apparent from the detailed description which follows, taken in conjunction with the accompanying drawings, which together illustrate, by way of example, features of the present disclosure, and wherein.

DETAILED DESCRIPTION

Figure 1:
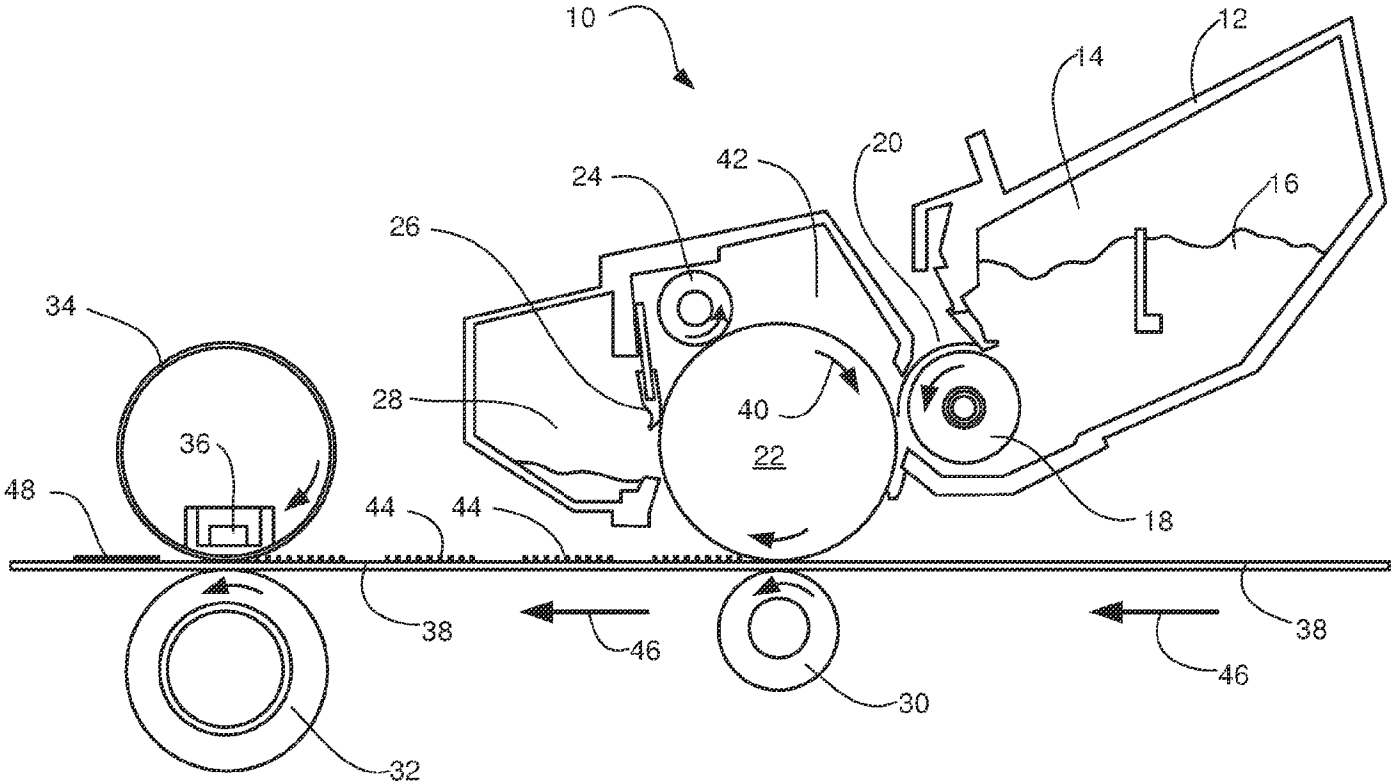
FIG. 1 is a side, cross-sectional view of the functional components of one embodiment of an electro-photographic printing system.

Reference will now be made to exemplary embodiments illustrated in the drawings, and specific language will be used herein to describe the same. It will nevertheless be understood that no limitation of the scope of the present disclosure is thereby intended. Alterations and further modifications of the features illustrated herein, and additional applications of the principles illustrated herein, which would occur to one skilled in the relevant art and having possession of this disclosure, are to be considered within the scope of this disclosure.

A side, cross-sectional view of the functional components of one embodiment of an electro-photographic printing system is provided in FIG. 1. This system includes a toner cartridge 10, generally including a housing 12 which contains a toner compartment 14 containing powdered toner 16, a toner feed roller 18, a developing sleeve 20 positioned partially around the toner feed roller, an electro-photographic (EP) drum 22, an electrical charging roller 24 positioned against the EP drum, a cleaning blade 26 and a waste toner hopper 28. The toner cartridge is typically configured to be removable from the printing system when the toner 16 in the toner compartment is exhausted, allowing easy replacement with a new fully charged toner cartridge.

Additional components that are fixed within the printing system are configured to work in combination with the toner cartridge to produce printed output. Specifically, the printing system includes a transfer roller 30, positioned adjacent to the EP drum 22, and a fuser 32 and fusing roller 34 positioned further downstream. The fusing roller includes a heating element 36 that heats the roller to fuse toner to the print media 38.

In operation, the EP drum 22 rotates clockwise, as indicated by arrow 40, and is first charged by the charging roller 24 to provide a uniform charge on the surface of the drum. The drum in an electro-photographic printing system typically includes a Charge Generation Layer (CGL, not shown) and a Charge Transport Layer (CTL, not shown), which is the outermost layer of the drum. After application of the uniform charge from the charging roller, the charge is modified by exposure to light, typically laser light within a developing region 42. This modified charge selectively attracts particles of toner to charged areas on the CTL surface of the drum by electrostatic forces as the drum rotates past the feed roller 18 in the developing region. The areas of the CTL to which the powdered toner sticks are those areas that represent an image to be transferred to the print media 38. The powdered toner is then transferred to the print media as the print media is drawn between the rotating drum and the rotating transfer roller 30.

The print media 38 with uncured toner 44 thereon continues to travel in the direction of arrows 46 and pass between the fuser 32 and fusing roller 34. These elements apply heat and pressure to the print media and the toner to cause it to fuse to the paper. This provides regions of cured toner 48 that provide the desired images on the print media.

As the printer drum 22 continues to rotate after applying uncured toner 44 to the print media 38, the drum surface rotates toward a cleaning unit that includes the waste toner hopper 28 and cleaning blade 26. When toner is transferred from the printer drum 22 to the print media 38, a small quantity of toner generally remains upon the CTL surface of the drum. The cleaning blade 26 is disposed against this surface and scrapes this toner off of the drum, and the waste toner falls into the waste hopper 28.

As noted above, the CTL is the outermost layer of the print drum 22. This layer is subject to wear during use from friction and other effects. One of the major contributors to CTL wear is friction between the surface of the CTL and the cleaning blade 26, which removes the un-transferred toner from the CTL. In view of this friction, the CTL is frequently designed to last a certain number of rotations, based on the page yield of the toner cartridge plus a certain amount of margin. For example, for a 10,000 page cartridge, the CTL may be designed to last 20,000 pages to accommodate users who print at ½ the average page coverage.

Residual or un-transferred toner on the CTL serves as a lubricant between the CTL of the printer drum 22 and the cleaning blade 26, and reduces friction (and thus wear) during normal use. However, in cases where a user prints on narrow media (such as envelopes), or prints documents having a print pattern that does not result in a good distribution of toner across the width of the drum (such as when printing columns of numbers), toner will not be applied to all areas of the drum. In areas where toner is not applied to the drum, there will be no residual toner to provide lubrication between the cleaning blade and the CTL surface. This will lead to increased friction and increased wear of the CTL, which can ultimately lead to failure of the CTL and result in dumping of toner into the printer. Moreover, when narrow media is used, the average page coverage tends to be much less than when printing on full-width media. In such situations users of a printer system will tend to have an expectation that the toner cartridge yield will be higher than expected, when it may actually be lower.

Advantageously, the inventors have developed a method for reducing wear on the electro-photographic printer drum in this type of printer. This method can be used when printing on narrow media, and can also be used when printing documents having irregular or low toner coverage, such as columns of numbers or text, whether the media is narrow or not. The method generally involves applying a very light halftone pattern of toner to non-image regions of the printer drum. Once a print image is transferred from the print drum and fused to the print media, a portion of the halftone pattern remains upon the print drum and provides lubrication between the surface of the drum and the cleaning blade.

Before providing additional discussion, it is believed that some definitions will be helpful. As used herein, the term "narrow media" refers to print media that is narrower than the maximum document width that the printer is capable of printing. For example, typical home or office printers are configured to print upon letter size paper that is 8½" wide. Thus any print media that is less than 8½" wide would be considered narrow media for this size of printer. Naturally, for a different size electro-photographic printer, narrow media would have reference to some other size.

The "non-image region" in one respect refers to any area outside the edges of the print media. This definition applies in the case of narrow media, where the non-image region will be any region outside the side edges of the media. The term "non-image region" also refers to any area within the edges of the print media in which there is non-uniform toner distribution required by the image to be printed, whether the page is full-width or not. This is generally the case with pages that include columns of numbers or the like, and can also apply with envelopes and other narrow media.

The term "light halftone pattern" is intended to mean an overall toner pattern of very light coverage. The amount of coverage that can be used for this method is the smallest amount of toner that will provide lubrication between the cleaning blade and the printer drum. It is also desirable to use the smallest effective amount because most of the toner that is applied for lubrication purposes will be scraped off of the drum by the cleaning blade and deposited into the waste hopper, and will thus be wasted. The density of the halftone pattern can be selected to balance between printer drum life, toner life, and waste toner hopper capacity. For example, darker halftone patterns may result in increased drum life, but can also result in decreased cartridge yield because toner usage will be increased. Additionally, an increased volume of wasted toner can require a larger waste toner hopper, which increases cartridge size and thus printer size.

The inventors believe that a halftone pattern of from about 0.1% coverage is suitable for providing lubrication in many cases, yet does not waste excessive amounts of toner. In general, it is believed that a halftone pattern of from about 0.1% to about 5% is likely to be satisfactory in most cases. More generally, the inventors believe that toner coverage at a rate that is less than about 10% can be used in this method. The application of more than about 10% toner coverage to the drum outside the margins of a page can result in engine dusting (i.e. dumping of excessive toner into the printer). Additionally, using more than this amount of toner is likely to be undesirable for a user simply because of the amount of toner that is consumed. Using more toner increases costs and increases the frequency at which the toner cartridge must be replaced.

Figure 2A:
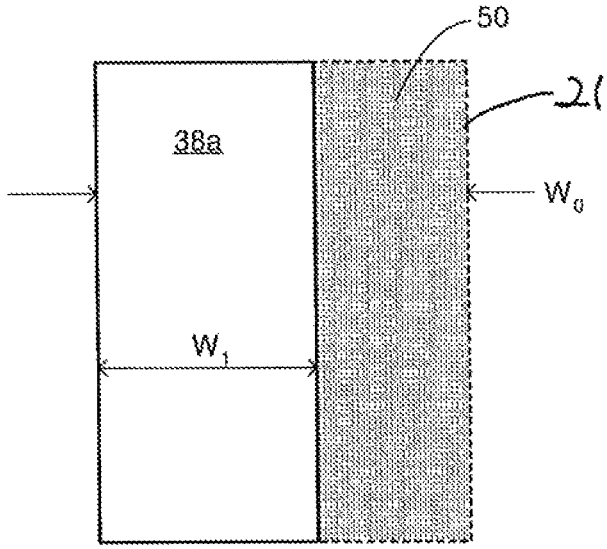
FIG. 2A is a plan view of a sheet of narrow print media aligned at a left margin of a print zone, showing an area beyond the right edge of the sheet in which a halftone pattern can be applied to reduce friction with the EP drum.
Figure 2B:
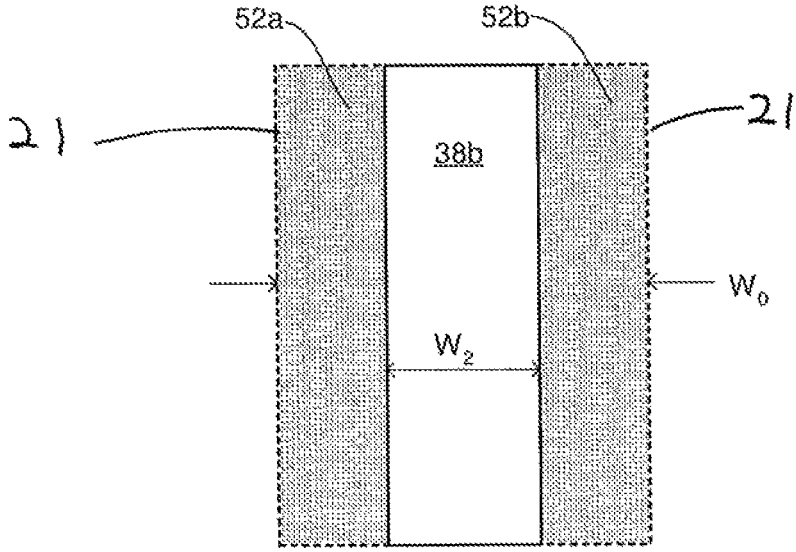
FIG. 2B is a plan view of a sheet of narrow print media aligned in the center of a print zone, showing two areas beyond each side edge of the sheet, in which a halftone pattern can be applied to reduce friction with the EP drum.

In the case of narrow media, the method involves printing the halftone pattern in the non image regions, which includes any region outside the side edges of the media. Two examples of how the method applies to narrow media are illustrated in FIGS. 2A and 2B. As shown in FIG. 2A, where the printer is designed for pages, outlined in dashed lines at 21, having a full media width of $W_0$, the media 38*a* that is actually printed (e.g. an envelope) can have a narrower width of $W_1$, and be positioned at the left margin, leaving a nonimage region 50 outside the edges of the media in which there is no media and no data to print. Alternatively, as shown in FIG. 2B, the narrow media 38*b* (e.g. a strip of adhesive labels) having a width of $W_2$ can be positioned in the center of the total width $W_0$, leaving two non-image regions 52*a, b* in which no media is present and no image is to be printed.

In both of these cases, under the method described herein, the light halftone pattern of toner is applied in the non-image regions 50 and 52*a, b*. When printing in this situation some of this toner will remain on the drum after rotation past the transfer roller, serving as a lubricant for the cleaning blade along the non-image portion of the drum. At the same time, there will be residual toner from the image that was printed within the edges of the print media, so that a small amount of toner will presumably remain across the entire width of the printer drum. Since this method requires no change to the structure of the printing system itself, it does not impact manufacturing cost or image quality.

Figure 3:
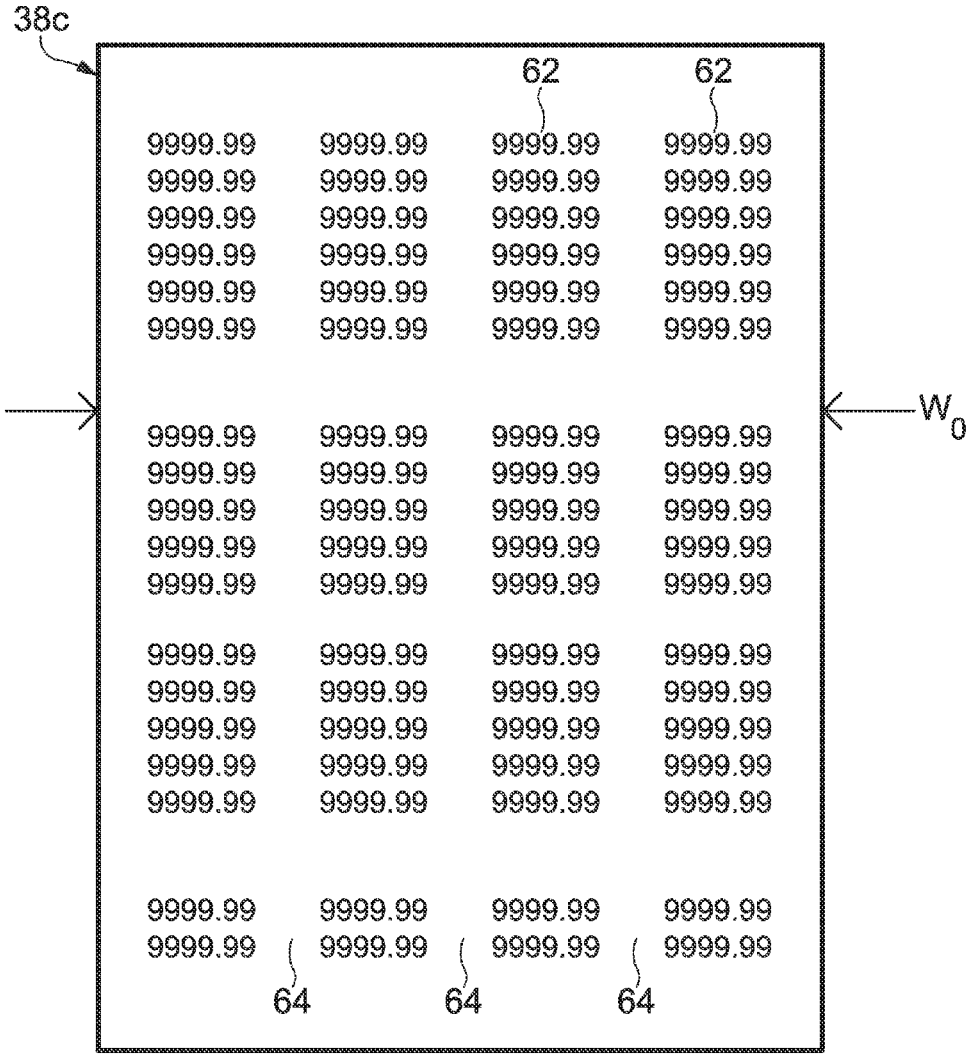
FIG. 3 is a plan view of a full-width sheet of print media having a print pattern that does not provide good toner distribution, with a halftone pattern applied over the entire sheet to reduce friction with the EP drum.

In another embodiment of the method, the non-image region can include some or all of the printed area of document when that document has non-uniform toner distribution. For example, non-uniform toner distribution can result when printing columns of numbers and the like, which leave long columns of open space, when printing address or other labels, and when printing envelopes. This can apply to full-width or narrow media. An example of print media having non-uniform toner distribution is illustrated in FIG. 3. This piece of full-width media 38*c* has width $W_0$ and is imprinted with text 62 comprising columns of numbers. These columns leave relatively large longitudinal bands 64 in which there is no image. In order to provide residual toner across substantially the entire width of the printer drum for lubrication against the cleaning blade, an alternative embodiment of the method involves printing a light halftone pattern of toner 66 over substantially the entire page area. Because the halftone pattern is very light and is uniformly distributed across the page, the pattern can be unnoticeable.

In this embodiment of the method the halftone pattern can be applied to all printed pages in a print job, or it can be intelligently applied only in usage situations that require it, such as when the horizontal distribution of exposure consistently results in unexposed columns of, for example, 1" or more. The exact algorithm for when to apply the halftone pattern can be optimized for each specific system. The visibility of the halftone pattern can also be considered during its optimization. As noted above, the density of the halftone pattern can be optimized between printer drum life, toner life, and waste toner hopper capacity. For example, darker halftone patterns may result in increased drum life, but can also result in decreased cartridge yield because toner usage would be increased. Additionally, an increased volume of wasted toner can require a larger waste toner hopper, which increases cartridge size and thus printer size.

Those of skill in the art will be aware that toner can sometimes transfer from the printer drum to the transfer roller in an electro-photographic printing system. When employing an embodiment of the method disclosed herein, this can also occur, particularly where narrow media is used and the halftone pattern is applied to the portion(s) of the print drum outside of the width of the media. In this case, toner will be present on the printer drum in areas where no media will separate the printer drum from the transfer roller, thus allowing toner to transfer to the transfer roller. Advantageously, the accumulation of toner on the transfer roller can be removed periodically by use of a reverse-charge cleaning cycle, as is already commonly done to clean transfer rollers. In a reverse-charge cleaning cycle, an electrostatic charge of reverse polarity is applied to the transfer roller, so that toner will be repelled from the transfer roller and back to the printer drum. The accumulated toner is thus removed from the transfer roller by the printer drum, then scraped off of the printer drum by the cleaning blade and deposited into the waste hopper.

Figure 4:
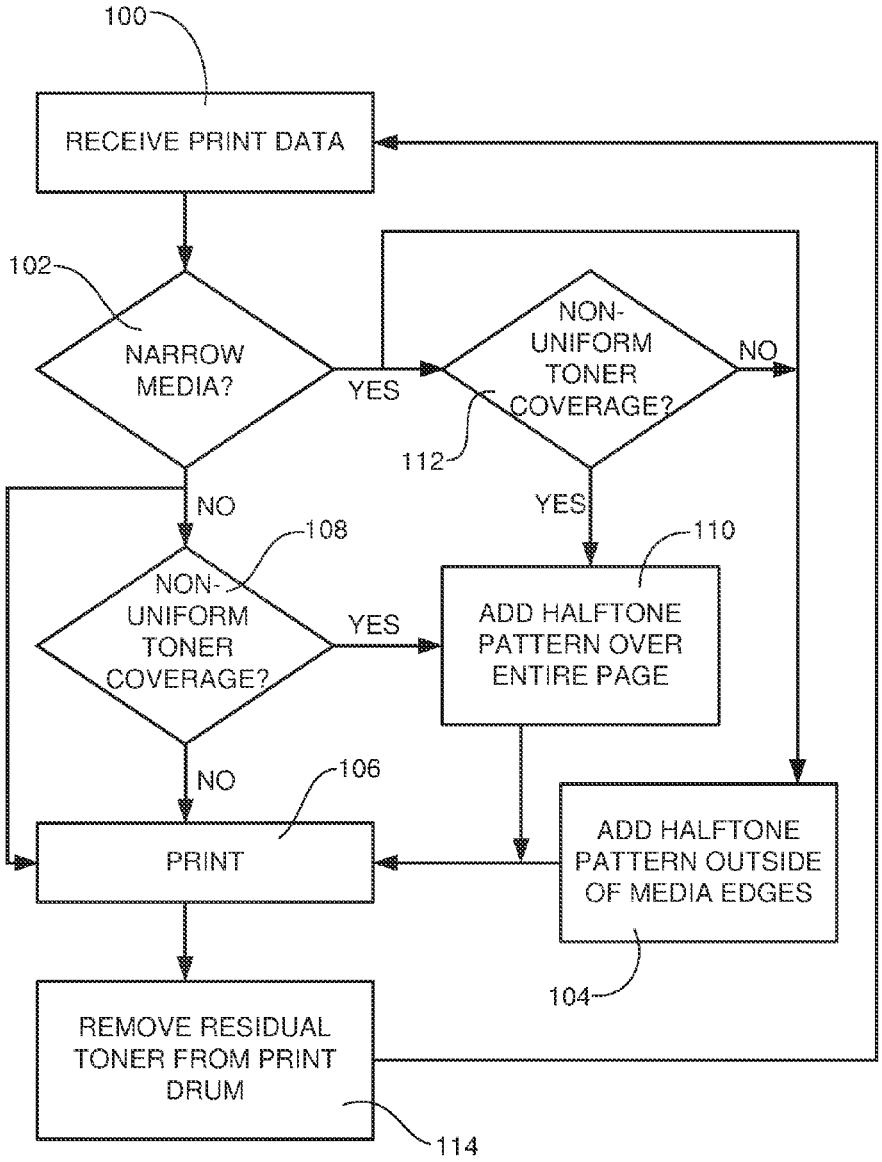
FIG. 4 is a flow chart showing the steps in one embodiment of a method for reducing wear on an electro-photographic printer drum.

A flowchart of the steps involved in an embodiment of the method is provided in FIG. 4. It is to be understood that the method disclosed herein can be viewed as a method of printing, and also as a method for reducing wear upon an electro-photographic printer drum. Additionally, the method can be implemented as a computer program comprising machine readable program code for causing a computing device associated with an electro-photographic printer to perform the steps discussed herein. The computing device can be a controller of a printer device itself, which receives data files representing print documents from another computer and then modifies those files, or it can be a separate computer device that is interconnected to the printer and provides and modifies document files before sending them to the printer.

Viewing FIG. 4, the embodiment of the method outlined here involves first receiving print data (step 100) for a document to print. After receiving the print data, several analysis steps are followed to determine whether and where to apply a halftone toner pattern. As noted above, these analysis steps can be performed by the printer itself after receiving a print job, or the steps can be performed before the print data file for a page is sent to the printer. Additionally, the application of a halftone pattern can be enabled or disabled entirely. This can be done, for example, by a user via a user input device, such as a control panel setting associated with the printer, or through a command (e.g. a PJL command) that is sent with a print job. Assuming that halftone printing is enabled, the first analysis step is to determine whether the print data is for a page of narrow print media or not (step 102). If the answer to this query is "yes", the system can proceed to modify the print data to include a halftone pattern in the non-image region(s) outside the edges of the narrow print media (step 104), then print the document (step 106).

If the answer to the first query is "no" (i.e. the media is full-width), the system can also move directly to print the document (step 106). Alternatively, the system can inquire whether the document includes low (or non-uniform) toner coverage (step 108). The question of non-uniform toner coverage is a question of degree, and can be determined based upon a threshold. For example, the threshold can be set to recognize non-uniform toner coverage where the horizontal distribution of exposure consistently results in unexposed columns of, for example, 1" or more. This is only one example. The exact algorithm for when to apply the halftone pattern can be optimized for each specific system. If the answer is "no", the system proceeds to print the page (step 106). However, if the answer to this question is "yes", the system then proceeds to modify the print data to include a halftone pattern over the entire document (step 110), in the manner discussed above.

Another approach is also depicted in FIG. 4. If the print data is for narrow media (determined at step 102) it is nevertheless possible that the page may also have non-uniform toner coverage. Thus, in the case of narrow media the system can next inquire whether the document includes low (or non-uniform) toner coverage (step 112). If not, the process moves on to step 104 and modifies the print data to include a halftone pattern in the non-image region(s) outside the edges of the print media, then prints the document (step 106). However, if the document is narrow and also has non-uniform toner coverage, as determined at step 112, the process moves to step 110 and applies a halftone toner pattern over the entire document, then moves on to print (step 106).

Following printing, the residual toner is removed from the print drum (step 114) and the process can then repeat, by receiving more print data (step 100). In the various embodiments thus described, this process provides a method for extending the life of an electro-photographic (EP) drum when printing on narrow media or when printing documents having non-uniform toner coverage. By applying a light halftone pattern of toner to non-image portions of the drum, residual toner provides lubrication for the cleaning blade, and helps prolong the life of the toner cartridge. Since this method requires no structural change in the printer system itself, it does not affect manufacturing cost or image quality.

It is to be understood that the above-referenced arrangements are illustrative of the application of the principles disclosed herein. It will be apparent to those of ordinary skill in the art that numerous modifications can be made without departing from the principles and concepts of this disclosure, as set forth in the claims.

What is claimed is:

1. A computer program comprising machine readable program code for causing a computing device associated with an electro-photographic printer to perform the steps of:

receiving a data file for a document to print;

recognizing a non-image region of the document; and causing the printer to apply a halftone pattern of toner in the non-image region to provide toner for lubrication between the electro-photographic printer drum and a cleaning blade of the printer, wherein the step of recognizing the non-image region comprises recognizing a longitudinal region of non-uniform toner coverage within a boundary of the document.

2. A computer program in accordance with claim 1, wherein the step of recognizing the non-image region comprises recognizing a document for narrow print media.

3. A computer program in accordance with claim 2, wherein the step of causing the printer to apply a halftone pattern of toner comprises causing the printer to apply the halftone toner coverage in a region outside of a boundary of the document.

4. A computer program in accordance with claim 1, wherein the step of causing the printer to apply a halftone pattern of toner comprises causing the printer to apply the halftone toner pattern over substantially an entire area of the print media.

5. A computer program for controlling a printer that includes an electro-photographic printer drum, a cleaning blade, a memory, and a computing device, the computer program residing in the memory of the printer and comprising:

instructions that cause the computing device to receive data representing a document;

instructions that evaluate the data to determine an image region of the document and a non-image region of the document; and instructions that determine portions of the electro-photographic printer drum to receive a halftone pattern of toner for lubrication between then electro-photographic printer drum and the cleaning blade based upon the evaluated image region of the document and the non-image region of the document, wherein the instructions that evaluate the data to determine the non-image region of the document includes recognizing a longitudinal region of non-uniform toner coverage within a boundary of the document.

6. The computer program of claim 5, wherein the punter includes a toner cartridge and further wherein one of the memory and the computing device are in the toner cartridge.

7. The computer program of claim 5, wherein the instructions that evaluate the data to determine the non-image region of the document includes recognizing a document for narrow print media.

8. The computer program of claim 7, further comprising instructions that cause the printer to apply the halftone pattern of toner in a region outside of a boundary of the document.

9. The computer program of claim 5, further comprising instructions that cause the printer to apply the halftone pattern or toner over substantially an entire area of a print media.

10. A computer program residing in a printer, the printer comprising:

a computing device to receive a data file for an image to print;

an electro-photographic printer drum to transfer toner to a print media that represents the image;

a cleaning blade to remove toner from the electro-photographic print drum; and a memory for storing the computer program including machine readable instructions that, when executed by the computing device, cause the computing device to:

determine a non-image region on the electro-photographic printer drum; and apply a halftone pattern of toner to a portion of the electro-photographic printer drum that corresponds to the non-image region for lubrication between the electro-photographic print drum and the cleaning blade, wherein the non-image region is determined by recognizing a longitudinal region of non-uniform toner coverage within a boundary of a document.

11. The computer program of claim 10, wherein the non-image region is determined by recognizing a document for narrow print media.

12. The computer program of claim 11, wherein the halftone pattern of toner is applied in a region outside of a boundary of the document.

13. The computer program of claim 10, wherein the halftone pattern of toner is applied over substantially an entire area of a print media.

* * * * *

UNITED STATES PATENT AND TRADEMARK OFFICE

CERTIFICATE OF CORRECTION

PATENT NO. : 8,655,215 B2
APPLICATION NO. : 13/547998
DATED : February 18, 2014
INVENTOR(S) : Steve Testardi et al.

It is certified that error appears in the above-identified patent and that said Letters Patent is hereby corrected as shown below:

In the Claims:

In column 7, line 23, in Claim 5, delete “then” and insert -- the --, therefor.

In column 7, line 31, in Claim 6, delete “punter” and insert -- printer --, therefor.

In column 8, line 6, in Claim 9, delete “or” and insert -- of --, therefor.

Signed and Sealed this
Third Day of June, 2014

Michelle K. Lee

Michelle K. Lee
*Deputy Director of the United States Patent and Trademark Office*